US012502580B2

(12) United States Patent
Zhang

(10) Patent No.: US 12,502,580 B2
(45) Date of Patent: Dec. 23, 2025

(54) MEMBRANE STRUCTURE FOR INTEGRATED PRODUCTION OF WATER BALL

(71) Applicant: Foshan Zhuo Yingda Plastic Co., Ltd, Foshan (CN)

(72) Inventor: Zhuokai Zhang, Foshan (CN)

(73) Assignee: Foshan Zhuo Yingda Plastic Co., Ltd, Foshan (CN)

( * ) Notice: Subject to any disclaimer, the term of this patent is extended or adjusted under 35 U.S.C. 154(b) by 174 days.

(21) Appl. No.: 18/436,464

(22) Filed: Feb. 8, 2024

(65) Prior Publication Data

US 2025/0135296 A1 May 1, 2025

(30) Foreign Application Priority Data

Oct. 30, 2023 (CN) ..... 202311421694.1

(51) Int. Cl.
*A63B 43/00* (2006.01)
*A63H 33/00* (2006.01)

(52) U.S. Cl.
CPC ..... *A63B 43/00* (2013.01); *A63H 33/00* (2013.01)

(58) Field of Classification Search
CPC ..... A63B 43/00; A63H 33/00; A63H 3/28; A63H 2027/1041; A63H 27/10; B65B 3/04
USPC ..... 446/267; 383/44; 137/255; 428/34.1–36.92
See application file for complete search history.

(56) References Cited

U.S. PATENT DOCUMENTS 1,703,463 A * 2/1929 Weigel ..... A63H 27/10 446/224
3,806,025 A * 4/1974 Marshall ..... F42D 1/20 383/44
4,850,912 A * 7/1989 Koyanagi ..... B65B 61/186 441/40
5,308,163 A * 5/1994 Abe ..... F16K 15/202 383/44
5,388,910 A * 2/1995 Koyanagi ..... B65D 33/01 426/106
5,540,720 A * 7/1996 Ortega ..... A63H 33/22 606/235
5,711,691 A * 1/1998 Damask ..... A63H 27/10 441/41
5,769,685 A * 6/1998 Nakamura ..... G09F 7/00 446/221
5,975,983 A * 11/1999 Panec ..... A63H 33/30 141/114
6,112,781 A * 9/2000 Baxter ..... A63H 27/10 141/331
6,827,099 B2 * 12/2004 Tanaka ..... B65B 7/08 383/44

(Continued)

*Primary Examiner* — Eugene L Kim
*Assistant Examiner* — Matthew B Stanczak
(74) *Attorney, Agent, or Firm* — Leason Ellis LLP

(57) ABSTRACT

A membrane structure for integrated production of a water ball is disclosed, including an integrated membrane, wherein the integrated membrane includes a membrane body portion and a pocket body portion, and a pocket body tear line is arranged between the membrane body portion and the pocket body portion; and the membrane body portion is provided with a water injection channel, and a one-way water inlet is arranged between the water injection channel and the pocket body portion.

10 Claims, 3 Drawing Sheets

(56) References Cited

U.S. PATENT DOCUMENTS 8,277,910 B2 * 10/2012 Koyanagi ..... F16K 15/147 428/35.9
9,051,066 B1 * 6/2015 Malone ..... B65B 3/17
D793,484 S * 8/2017 Khubani ..... D21/453
9,776,744 B2 * 10/2017 Khubani ..... A63H 27/10
9,783,327 B2 * 10/2017 Khubani ..... B65B 3/17
9,844,737 B1 * 12/2017 Warner ..... A63H 27/10
9,944,415 B2 * 4/2018 Lin ..... A63H 27/10
9,950,817 B2 * 4/2018 Malone ..... B65B 3/003
10,227,146 B2 * 3/2019 Khubani ..... A63H 27/10
10,589,184 B2 * 3/2020 Mowbray ..... A63H 27/10
D962,352 S * 8/2022 Davis ..... D21/453
11,465,785 B1 * 10/2022 Dodgen ..... A45F 3/18
D1,018,689 S * 3/2024 Mowbray ..... D21/440
D1,049,250 S * 10/2024 Wang ..... D21/453
12,274,951 B1 * 4/2025 Cantrell ..... A63H 27/10
12,337,257 B1 * 6/2025 Zhang ..... A63H 33/18
2004/0265523 A1 * 12/2004 Koyanagi ..... B65D 81/052 156/361
2008/0121309 A1 * 5/2008 Boise ..... A63H 27/10 141/313
2008/0166943 A1 * 7/2008 Hou ..... A63H 27/10 446/221
2009/0047864 A1 * 2/2009 Burchett ..... A63H 27/10 446/224
2013/0118640 A1 * 5/2013 Saggio ..... A63H 27/10 141/313
2013/0240082 A1 * 9/2013 Mueller ..... A61M 1/0231 141/59
2015/0259085 A1 * 9/2015 Malone ..... A61B 5/1427
2016/0243454 A1 * 8/2016 Laden ..... A63H 27/10
2016/0368628 A1 * 12/2016 Khubani ..... A63H 27/10
2016/0368630 A1 * 12/2016 Khubani ..... F17C 1/00
2017/0043270 A1 * 2/2017 Harter ..... A63H 27/10
2017/0106248 A1 * 4/2017 Burke ..... A63B 69/0095
2017/0121040 A1 * 5/2017 Khubani ..... A63H 37/00
2017/0225809 A1 * 8/2017 Kamhi ..... B65B 7/025
2017/0240304 A1 * 8/2017 Lin ..... A63H 27/10
2017/0361239 A1 * 12/2017 Malone ..... A63H 27/10
2018/0079535 A1 * 3/2018 Khubani ..... B65B 3/17
2018/0104545 A1 * 4/2018 Burke ..... A63B 41/02
2019/0201749 A1 * 7/2019 Burke ..... A63B 37/004
2022/0203256 A1 * 6/2022 Chen ..... A63B 43/00
2025/0090973 A1 * 3/2025 Chen ..... A63H 23/10
2025/0135296 A1 * 5/2025 Zhang ..... A63B 43/00
2025/0186899 A1 * 6/2025 Chen ..... A63B 37/08

* cited by examiner

MEMBRANE STRUCTURE FOR INTEGRATED PRODUCTION OF WATER BALL

CROSS-REFERENCE TO RELATED APPLICATIONS

This application claims priority to Chinese patent application No. 202311421694.1 filed Oct. 30, 2023. The contents of this application are incorporated herein by reference in their entirety.

TECHNICAL FIELD

The present disclosure relates to the technical field of toys, and in particular, to a membrane structure for integrated production of a water ball.

BACKGROUND

A water ball can be used as a toy and other utensils. The water ball is formed by injecting water into a water pocket. In case of a requirement for a large-scale production of water balls, it is inefficient to inject water into the water pockets one by one, which affects the improvement of the production efficiency.

SUMMARY

The present disclosure aims to at least solve one of the technical problems in the existing technology. Therefore, the present disclosure provides a membrane structure for integrated production of a water ball.

The technical scheme taught by the present disclosure to solve the technical problems is to provide a membrane structure for integrated production of a water ball, including an integrated membrane, where the integrated membrane includes a membrane body portion and a pocket body portion, and a pocket body tear line is arranged between the membrane body portion and the pocket body portion; and the membrane body portion is provided with a water injection channel, and a one-way water inlet is arranged between the water injection channel and the pocket body portion.

According to the membrane structure for integrated production of a water ball provided by the present disclosure, at least the following technical effects are realized: with a design in which a membrane is connected to a plurality of pocket body portions, it is only necessary to connect the integrated membrane to a water source during production, so as to inject water into the pocket body portions through the water injection channel; and after the water injection is completed, the pocket body portion can be torn out to obtain a water ball with water injected; and the one-way water inlet ensures that the water will not flow back out.

In some preferred embodiments of the present disclosure, the integrated membrane is formed at least by laminating two single membranes, and a cavity between the two single membranes is used as a cavity of the pocket body portion and the water injection channel.

In some preferred embodiments of the present disclosure, the water injection channel includes a main water injection channel and a branch water injection channel, and the branch water injection channel is in communication with the one-way water inlet.

In some preferred embodiments of the present disclosure, the main water injection channel is provided with a main water injection tear opening.

In some preferred embodiments of the present disclosure, the one-way water inlet includes a membrane flat pipe, and the membrane flat pipe includes a flat pipe water inlet and a flat pipe stretching portion.

In some preferred embodiments of the present disclosure, the one-way water inlet includes a peripheral limiting and pressing edge.

In some preferred embodiments of the present disclosure, the pocket body portion is peripherally provided with a peripheral reinforcing and pressing edge.

In some preferred embodiments of the present disclosure, both ends of the membrane body portion are provided with a clamping portion.

In some preferred embodiments of the present disclosure, a clamping portion tear line is arranged between the clamping portion and the membrane.

In some preferred embodiments of the present disclosure, the membrane body portion is provided with an outer tear line at an outer side of the membrane body portion, and the outer tear line is connected to the pocket body tear line.

The beneficial effects of the present disclosure are as follows:

1. the newly designed membrane is of a sheet-like shape before water injection, and therefore is convenient to be stored;
2. during the water injection, several pocket body portions on the membrane can be injected with water at the same time by a single water injection, which improves the efficiency of production;
3. after the water injection, the pocket body portion is torn out to be used as a water ball, such that the operation is simple and convenient; and
4. the new design is not only suitable for water injection of a water ball, but also suitable for injecting other fluids, for example, the new design is also suitable for gas injection of a balloon.

Additional aspects and advantages of the present disclosure will be set forth in part in the following description, some of which will be apparent from the following description, or will be learned by practice of the present disclosure.

BRIEF DESCRIPTION OF DRAWINGS

Additional aspects and advantages of the present disclosure will become apparent and readily appreciated from the following description of the embodiments with reference to the accompanying drawings. In the drawings.

REFERENCE NUMERALS

Figure 1:
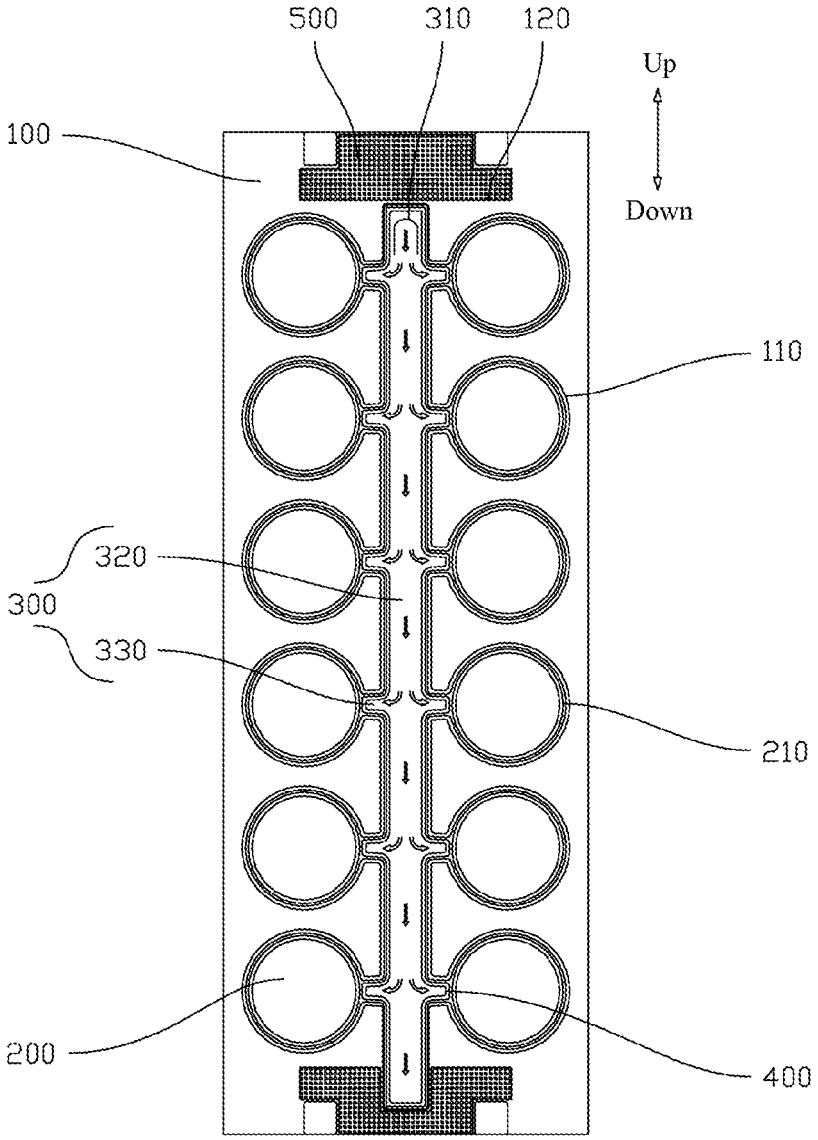
FIG. 1 is a schematic diagram of a structure according to the present disclosure.

100: membrane body portion; 110: pocket body tear line; 120: clamping portion tear line; 130: outer tear line; 200: pocket body portion; 210: peripheral reinforcing and pressing edge; 300: water injection channel; 310: main water injection tear opening; 320: main water injection channel; 330: branch water injection channel; 400: one-way water inlet; 410: membrane flat pipe; 411: flat pipe water inlet; 412: flat pipe stretching portion; 420: peripheral limiting and pressing edge; and 500: clamping portion.

DETAILED DESCRIPTION

Embodiments of the present disclosure will be described in detail below, and examples of the embodiments are shown in the accompanying drawings, where the same or similar reference numerals indicate the same or similar elements or elements having the same or similar functions throughout. The embodiments described below with reference to the accompanying drawings are illustrative only for the purpose of explaining the present disclosure, and are not to be construed as limiting the present disclosure.

In the description of the present disclosure, it should be understood that the directions or positional relationships indicated by terms such as "upper", "lower", "front", "rear", "left", "right" and the like are those shown based on the accompanying drawings, and are merely intended to facilitate and simplify the description of the present disclosure rather than indicating or implying that the indicated apparatus or element must have a specific direction and must be configured and operated according to the specific direction. Therefore, these directions or positional relationships should not be construed as limiting the present disclosure.

In the description of the present disclosure, "multiple" means two or more, and "greater than", "less than", "more than" and the like are understood as excluding the original number. In the description of the present disclosure, unless otherwise explicitly defined, terms such as "arrange", "mount", "connect" and the like should be understood in a broad sense, and those skilled in the art can reasonably determine the specific meanings of the above terms in the present disclosure in conjunction with the specific contents of the technical schemes.

FIG. 1 is a schematic diagram of a structure according to an embodiment of the present disclosure. Referring to FIG. 1, an embodiment of the present disclosure provides a membrane structure for integrated production of a water ball, which is used to inject water into a plurality of water ball products at a time to improve the production efficiency of water balls.

Further, the membrane structure for integrated production of a water ball includes an integrated membrane, where the integrated membrane includes a membrane body portion 100 and a pocket body portion 200, and a pocket body tear line 110 is arranged between the membrane body portion 100 and the pocket body portion 200. That is, the whole membrane body portion 100 is a sheet-like structure before water injection, and the pocket body portion 200 can be torn out of the membrane body portion 100 through the pocket body tear line 110 to form a separate pocket body portion 200.

Further, a water injection channel 300 is arranged on the membrane body portion 100, and a one-way water inlet 400 is arranged between the water injection channel 300 and the pocket body portion 200. That is, the pocket body portion 200 is injected with water through the water injection channel 300, and the one-way water inlet 400 ensures that the water in the pocket body portion 200 will not flow back out after the water injection.

Figure 2:
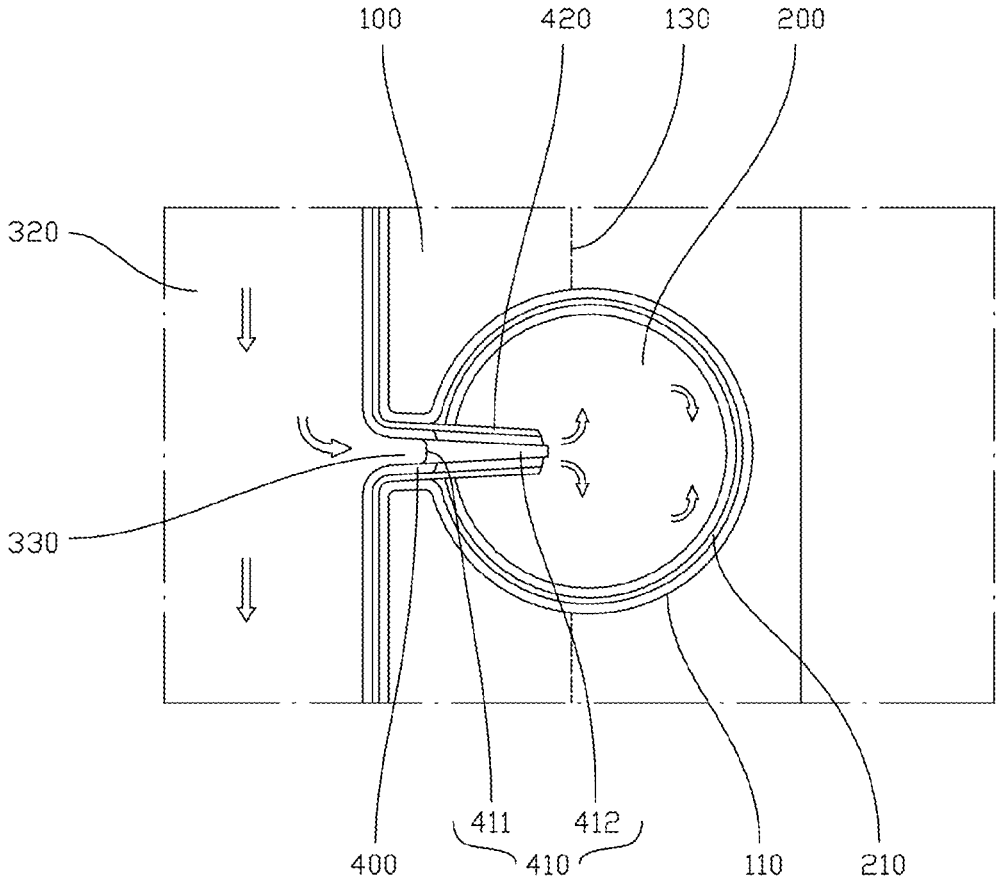
FIG. 2 is an enlarged view of a part of a pocket body portion according to the present disclosure.
Figure 3:
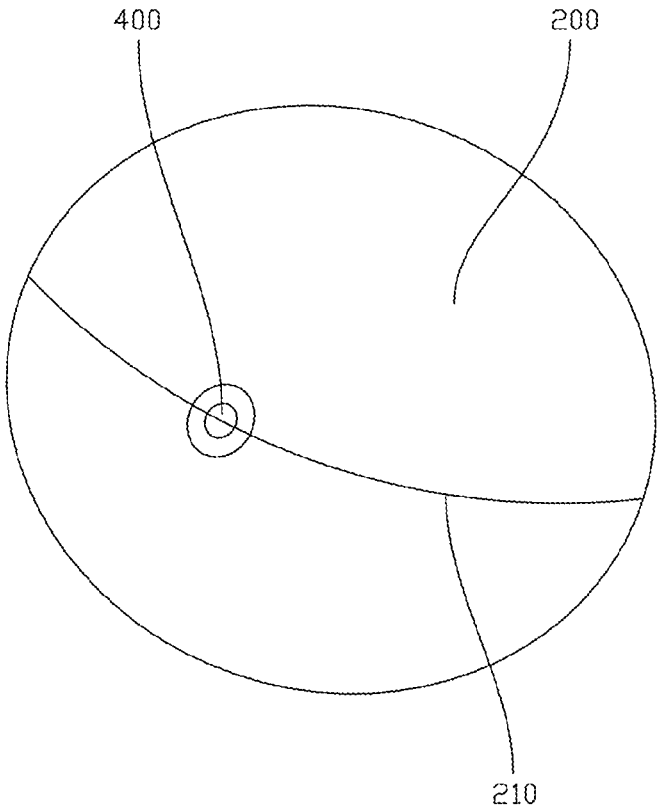
FIG. 3 is a schematic diagram of a pocket body portion after water injection according to the present disclosure.

Referring to FIG. 2, during actual production, it is only necessary to take out the integrated membrane and connect the water injection channel 300 to a water source, such that the water can be injected into the pocket body portion 200 on the membrane body portion 100 through the water injection channel 300. The pocket body portion 200 with water injected is then expanded from a sheet-like shape into a ball-like shape. Referring to FIG. 3, after the water injection is completed, the expanded pocket body portion 200 can be torn out of the membrane body portion 100 through the pocket body tear line 110 to obtain a water ball with the water injection completed. The one-way water inlet 400 ensures that water in the pocket body portion 200 will not flow back out during and after the water injection process and even after the pocket body portion 200 is torn out.

In some embodiments, the pocket body portion 200 may also be used as a balloon when being injected with gas.

In some embodiments, referring to FIG. 1, the integrated membrane is formed at least by laminating two single membranes, and a cavity between the two single membranes is used as a cavity of the pocket body portion 200 and the water injection channel 300.

In some embodiments, the water injection channel 300 includes a main water injection channel 320 and a branch water injection channel 330, and the branch water injection channel 330 is in communication with the one-way water inlet 400, that is, a branch water injection channel 330 corresponds to a pocket body portion 200. In this way, when water is injected, it is only necessary to connect the main water injection channel 320 to one water source.

In some embodiments, the main water injection channel 320 is provided with a main water injection tear opening 310, and the main water injection channel 320 can be connected to the water source for receiving water after the main water injection tear opening 310 is torn.

In some embodiments, referring to FIG. 2, the one-way water inlet 400 includes a membrane flat pipe 410, and the membrane flat pipe 410 includes a flat pipe water inlet 411 and a flat pipe stretching portion 412. When water is injected through the one-way water inlet 400, the membrane flat pipe 410 is enough to ensure a water flow to be smoothly injected into the pocket body portion 200. After the water injection is completed, the flat pipe stretching portion 412 of the membrane flat pipe 410 will be bent under the action of water pressure and be in a state of closely adjacent to an inner wall of the pocket body portion 200, and in this state, the water in the pocket body portion 200 cannot leak through the membrane flat pipe 410.

In some embodiments, the one-way water inlet 400 can be a one-way valve structure of other balloons or water balls in the existing technology.

In some embodiments, the one-way water inlet 400 includes a peripheral limiting and pressing edge 420 for improving the structural strength of the pocket body portion 200 at the position of the one-way water inlet 400, and especially for preventing the one-way water inlet 400 from being damaged when the pocket body portion 200 is torn out.

In some embodiments, the pocket body portion 200 is peripherally provided with a peripheral reinforcing and pressing edge 210 for improving the overall structural strength of the pocket body portion 200, and especially for preventing a peripheral line position from being damaged when the pocket body portion 200 is torn out.

In some embodiments, both ends of the membrane body portion 100 are provided with a clamping portion 500 to facilitate the clamping of the membrane body portion 100 by a machine.

In this embodiment, optionally, the clamping portion 500 is embossed with an anti-slip pattern.

In some embodiments, a clamping portion tear line 120 is arranged between the clamping portion 500 and the membrane body portion 100 to facilitate the tearing of the clamping portion 500.

In some embodiments, the membrane body portion 100 is provided with an outer tear line 130 at an outer side of the membrane body portion, and the outer tear line 130 is connected to the pocket body tear line 110, such that an outer portion of the membrane body portion 100 can be torn out along the outer tear line 130, and the pocket body portion 200 can be exposed and easily torn out.

In the description of the specification, the description with reference to the terms "some embodiments" or "it may be contemplated" or the like means the specific features, structures, materials or characteristics described in combination with the embodiment or example are included in at least one embodiment or example of the present disclosure. In this specification, the schematic expression of the above terms does not necessarily refer to the same embodiments or examples. Furthermore, the specific features, structures, materials, or characteristics described can be combined in any suitable manner in any one or more embodiments or examples.

Although the embodiments of the present disclosure have been shown and described, it may be understood by those of ordinary skill in the art that various changes, modifications, substitutions, and alterations may be made to these embodiments without departing from the principle and purpose of the present disclosure, and the scope of the present disclosure is defined in the claims and equivalents thereof.

What is claimed is:

1. A membrane structure for integrated production of a water ball, comprising an integrated membrane, wherein the integrated membrane comprises a membrane body portion and a pocket body portion, and a pocket body tear line is arranged between the membrane body portion and the pocket body portion; and wherein the membrane body portion is provided with a water injection channel, and a one-way water inlet is arranged between the water injection channel and the pocket body portion.

2. The membrane structure for integrated production of a water ball according to claim 1, wherein the membrane body portion is formed at least by laminating two single membranes, and a cavity between the two single membranes is used as a cavity of the pocket body portion and the water injection channel.

3. The membrane structure for integrated production of a water ball according to claim 1, wherein the water injection channel comprises a main water injection channel and a branch water injection channel, and the branch water injection channel is in communication with the one-way water inlet.

4. The membrane structure for integrated production of a water ball according to claim 3, wherein the main water injection channel is provided with a main water injection tear opening.

5. The membrane structure for integrated production of a water ball according to claim 1, wherein the one-way water inlet comprises a membrane flat pipe, and the membrane flat pipe comprises a flat pipe water inlet and a flat pipe stretching portion.

6. The membrane structure for integrated production of a water ball according to claim 1, wherein the one-way water inlet comprises a peripheral limiting and pressing edge.

7. The membrane structure for integrated production of a water ball according to claim 1, wherein the pocket body portion is peripherally provided with a peripheral reinforcing and pressing edge.

8. The membrane structure for integrated production of a water ball according to claim 1, wherein both ends of the membrane body portion are provided with a clamping portion.

9. The membrane structure for integrated production of a water ball according to claim 8, wherein a clamping portion tear line is arranged between the clamping portion and the membrane body portion.

10. The membrane structure for integrated production of a water ball according to claim 1, wherein the membrane body portion is provided with an outer tear line at an outer side of the membrane body portion, and the outer tear line is connected to the pocket body tear line.

* * * * *